United States Patent [19]

Wyler

[11] 4,087,797

[45] May 2, 1978

[54] SYSTEM FOR DETECTING WATER IN STEAM PIPES

[75] Inventor: John S. Wyler, West Goshen, Pa.

[73] Assignee: Westinghouse Electric Corp., Pittsburgh, Pa.

[21] Appl. No.: 706,333

[22] Filed: Jul. 19, 1976

[51] Int. Cl.[2] ..... G08B 21/00

[52] U.S. Cl. ..... 340/229; 415/118; 340/222; 340/236; 340/240

[58] Field of Search ..... 340/229, 240, 236, 222; 415/118; 60/223, 227

[56] References Cited

U.S. PATENT DOCUMENTS

| | | | |
|---|---|---|---|
| 2,551,229 | 5/1951 | Alford et al. | 60/223 |
| 2,799,851 | 7/1957 | Moore | 340/222 |
| 3,685,292 | 8/1972 | Brown | 415/118 |
| 3,958,092 | 5/1976 | Hoover | 340/240 |

*Primary Examiner*—Glen R. Swann, III

*Attorney, Agent, or Firm*—F. J. Baehr, Jr.

[57] ABSTRACT

A pressure transducer is utilized to detect water in a steam pipe utilized in a steam turbine, the transducer produces an output signal which is converted to a control signal that operates an annunciator and/or a valve to protect a steam turbine from water damage.

6 Claims, 1 Drawing Figure

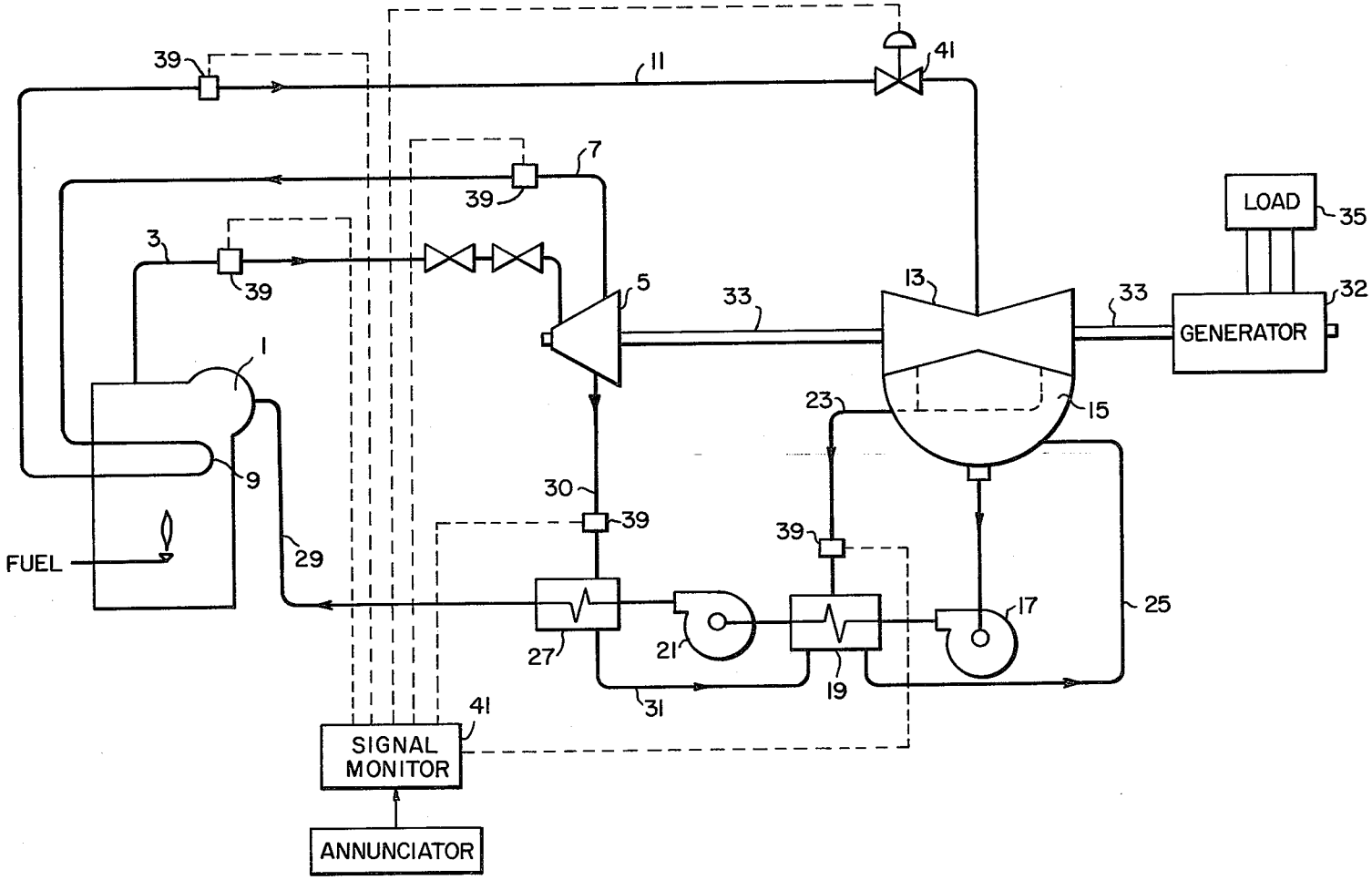
LOAD
GENERATOR
SIGNAL MONITOR
ANNUNCIATOR
FUEL
35
32
33
15
25
17
41
13
23
39
19
21
31
11
5
7
30
27
29
9
1
3

SYSTEM FOR DETECTING WATER IN STEAM PIPES

BACKGROUND OF THE INVENTION

This invention relates to the detection of water in steam pipes and more particularly to the detection of water in steam pipes connected with a steam turbine.

To meet the increased need for electrical energy the rating of turbogenerator units has increased, causing operational maintenance problems to become more critical. In recent years there has been an alarming increase in the frequency of incidents involving the induction of water or cool vapor into steam turbines. This undesirable introduction of water or cool vapor into the steam turbine may occur at numerous locations including the main steam inlet piping, hot reheat steam inlet piping, cold reheat steam piping, extraction steam connections, gland steam sealing systems and turbine drains and often results in structural damage to the turbine and unscheduled down time for the unit.

The instances of water injection in steam turbines have occurred with such frequency that the American Society of Mechanical Engineers has formed a special committee to study and make recommendations as to how to prevent such water damage. In spite of following the recommendation of this committee utilities still experience serious water injection incidents.

Prompt indication of water introduction into the piping will facilitate the identification of the causes of water induction, i.e., operating procedures, operator error or equipment malfunction and once the causes are identified corrective action can be implemented to reduce the occurrence of the incidents as well as to reduce the consequences and severity of the incidents.

SUMMARY OF THE INVENTION

In general, a system for detecting whether the fluid in a conduit is steam, water or a mixture thereof, when made in accordance with this invention, comprises an opening in the conduit, a pressure transducer in fluid communication with the conduit through the opening. The pressure transducer produces a signal which varies almost immediately as a result of temperature and pressure variations of the fluid and cooperates with means responsive to a predetermined change in said signal to produce a control signal which indicates there is water in the steam conduit.

BRIEF DESCRIPTION OF THE DRAWING

The object and advantages of this invention will become more apparent from reading the following detailed description in connection with the accompanying drawing, in which:

The sole FIGURE is a schematic diagram of a fossil fuel steam power plant incorporating this invention.

DESCRIPTION OF THE PREFERRED EMBODIMENTS

Referring now to the drawing in detail, there is shown a steam power plant in which superheated steam is produced in a boiler 1 and is fed via a main steam pipe or conduit 3 to a high pressure turbine 5 which converts some of the heat and pressure energy in the steam to rotating mechanical energy. The exhaust from the high pressure turbine 5 returns to the boiler 1 via a cold reheat pipe or conduit 7. The cold reheat pipe is disposed in fluid communication with a reheater heat exchanger 9 disposed in the boiler 1. After passing through the reheater heat exchanger portion 9 of the boiler 1 the exhaust from the high pressure turbine 5 is superheated and flows via the hot reheat pipe or conduit 11 to a low pressure turbine 13, which converts more of the heat and pressure energy in the steam into rotating mechanical energy. The exhaust from the low pressure turbine 13 is condensed in a condenser 15 forming condensate. A condensate pump 17 takes its suction from the condenser 15 and pumps the condensate through a low pressure feedwater heater 19 to the suction of a boiler feedpump 21.

Steam supplying the heat to the low pressure feedwater heater 19 is extracted from an intermediate stage of the low pressure turbine 13 and is supplied to the feedwater heater 19 via the extraction pipe or conduit 23. Condensate collected in the low pressure feedwater heater 19 is cascaded back to the condenser 15 via the low pressure heater drain piping or conduit 25.

The boiler feedpump 21 raises the pressure of the condensate above the pressure in the boiler and pumps feedwater through a high pressure feedwater heater 27 and feedwater piping or conduit 29 which is in fluid communication with the boiler 1. An extraction pipe or conduit 30 supplies the heat energy for heating the feedwater passing through high pressure feedwater heater 27. Condensate collected in the high pressure feedwater heater 27 is cascaded back to the low pressure heater 19 via the heater drain pipe or conduit 31.

A generator 32 is connected on a common shaft 33 with the high and the low pressure turbines 5 and 13, respectively.

The generator 32 converts the rotating mechanical energy produced by the turbines 5 and 13 to electrical energy which is supplied to a load 35 such as a city and/or factory.

Rapid changes in the load on the generator produce rapid changes in the pressure within the turbines and have a tendency to cause slugs of condensate to flow back through the extraction pipes 23 or 30. Extraction lines have also caused water injection problems due to high levels of condensate in the feedwater heaters. Water has been introduced into the turbines by the main steam piping 3, cold reheat piping 7 (as often feedwater is sprayed into the cold reheat pipe to control the temperature at the inlet of the reheater and at low loads condensate runs along the pipe wall and into the turbine) and hot reheat pipes (particularly in nuclear steam power plants where moisture separator reheaters are utilized).

Knowledge of the exact cause of the water injection into the turbine is not precise as thermocouples and other devices herebefore utilized had a response lag, which indicated the water injection after the occurrence and damage to the turbine had already occurred.

This invention utilizes a piezoelectric pressure transducer 39 such as Kistler Model 606A disposed so that the diaphragm thereof is in direct contact with the fluid in the pipe by providing a hole or opening in the pipe and connecting the transducer to the pipe utilizing conventional piping techniques.

With changes in fluid temperature the diaphragm will experience thermal expansion and contraction inducing a stress in the pressure sensing element. Stresses in the pressure sensing element are also produced by pressure oscillations so that the pressure transducer reflects both temperature and pressure variations. The pressure transducers 39 are rugged and able to withstand the high pressures and temperatures encountered in steam power plants and produce a signal free from background interference and noise and having large voltage amplitudes. The a.c. voltage output of the pressure transducer is transmitted to a signal monitor 41 which in its simplest form has electronic circuitry that responds to the a.c. input voltage to produce an output control signal, when the a.c. input signal exceeds a predetermined level. It has been discovered that slugs of water or water droplets in the steam produce identifiable output signals from pressure transducers.

With more sophisticated electronic circuitry the signal monitors can identify voltage amplitude as well as frequency variations in a.c. signals from transducers so that different amounts of water in the steam produce identifiably different input signals, for example slugs of water produced a lower frequency signal than small droplets admixed with the steam. Utilizing a signal monitor that recognizes multiple combinations of a.c. voltage amplitude and frequency, output signals can discriminate the characteristics of the input signal to produce output or control signals that not only indicate the presence of water in steam piping, but also produce a signal indicative of the amount and character of the water in steam piping. Such control signals may be utilized in an annunciator to give visible and/or audible signals to operators to inform them of not only the presence of water in a steam pipe, but also the type of water in a steam pipe, which would give them sufficient information to take corrective action. On the other hand, the control signals could be utilized to operate a valve if, for example, the transducer 39 would indicate a slug of water in the hot reheat piping and it is known that if this water entered the turbine it would cause damage thereto, it would be desirable to close a valve and prevent damage to the turbine. Such control signals may also be utilized in a digital-electric-hydraulic steam turbine control system which is capable of informing the operator of the problem and/or automatically taking corrective action if the amount of water detected exceeds a predetermined level by automatically operating appropriate valving.

Rapid and accurate detection of water in steam pipes can be utilized advantageously to inform the operators so that they may take timely corrective action, to increase the general knowledge as to the origin and type of water being introduced into turbines relative to variations in operating conditions or procedures, to assist designers in improving their designs in order to eliminate or greatly reduce water induction into the turbine, and to provide reliable protective devices, which will prevent water damage to steam turbines.

What is claimed is:

1. A system for detecting whether fluid in a conduit is steam, water or a mixture thereof, said system comprising a conduit, an opening in said conduit, a pressure transducer in fluid communication with said conduit through said opening, said pressure transducer producing a signal which varies as a result of steam, water or a mixture thereof in said conduit, and a signal monitor responsive to a predetermined change in said signal to produce a control signal which indicates whether there is steam, water or a mixture thereof in said conduit.

2. A system as set forth in claim 1 and further comprising means responsive to said control signal to operate a valve.

3. A system as set forth in claim 1 and further comprising means responsive to said control signal to produce an audible signal.

4. A system as set forth in claim 1 and further comprising means responsive to said control signal to produce a visible signal.

5. A system as set forth in claim 1 and further comprising means responsive to said control signal to produce an audible and visible signal.

6. A system as set forth in claim 1 and further comprising means responsive to said control signal to give an audible and a visible signal and to operate a valve.

* * * * *